United States Patent [19]

Lalancette et al.

[11] Patent Number: 4,639,309

[45] Date of Patent: Jan. 27, 1987

[54] PROCESS FOR THE DEHALOGENATION OF POLYHALOGENATED HYDROCARBON CONTAINING FLUIDS

[75] Inventors: Jean-Marc Lalancette, Sherbrooke; Germain Belanger, St-Germain de Grantham, both of Canada

[73] Assignee: Hydro-Quebec, Montreal, Canada

[21] Appl. No.: 777,300

[22] Filed: Sep. 18, 1985

[51] Int. Cl.[4] ..... C10G 17/00

[52] U.S. Cl. ..... 208/262; 585/469

[58] Field of Search ..... 208/262; 585/469

[56] References Cited

U.S. PATENT DOCUMENTS 4,379,746 4/1983 Norman et al. ..... 208/262

*Primary Examiner*—Curtis R. Davis

*Attorney, Agent, or Firm*—Cushman, Darby & Cushman

[57] ABSTRACT

The invention relates to an improved process for the dehalogenation of polyhalogenated hydrocarbons from a fluid containing same wherein the dehalogenation is carried out through the reaction of sodium or potassium, which comprises contacting a dispersion of sodium or potassium over the surface of a particulate inert material having a density of at least 2.0 with a polyhalogenated hydrocarbon contaminated hydrocarbon oil, said mixture being in an inert atmosphere, heated to a temperature of at least 100° C. and under constant agitation whereby the coating of sodium or potassium over the surface of the particulate inert material reacts with the halogen of the polyhalogenated hydrocarbon to form the corresponding sodium or potassium halide which is constantly removed from the active surface by abrasion and recovering the liquid, hydrocarbon oil substantially devoided of polyhalogenated hydrocarbon; and if desired an excess of sodium or potassium can be added to remove the remaining trace of halogen whereby the excess of sodium or potassium can be used for treating the next batch of contaminated fluid.

14 Claims, No Drawings

PROCESS FOR THE DEHALOGENATION OF POLYHALOGENATED HYDROCARBON CONTAINING FLUIDS

BACKGROUND OF THE INVENTION

Polyhalogenated organic substances such as polychlorinated biphenyls (PCB) have been used in many systems either as hydraulic fluid, heat exchange media or dielectric components in electrical transformers or condensers. In spite of excellent technical performances however, the environmental problems associated with the use of such substances has led to their withdrawal from previously widespread applications.

The substitution of non halogenated hydrocarbons to PCB has led in many cases to mixtures of various composition of non halogenated and halogenated materials. Since some environmental protection agencies have ruled that concentrations as low as one part per million of PCB in mineral oils used in electrical equipments or as hydraulic fluids was objectionable, even a slight contamination of a given lot of non halogenated mineral oil by some residual PCB left in a piece of equipment generates an environmental pollution in the case of a spill or leak.

It is to be underlined here that non halogenated oils used in electrical equipments or hydraulic systems is relatively expensive, the cost being of the order of several dollars per liters. Therefore, a slight contamination by PCB, by rendering a given charge of mineral oil improper for use corresponds to a serious monetary loss if the whole contaminated lot has to be discarded or destroyed for the sake of a few ppm of PCB.

Therefore it has been found desirable to use a method by which a given lot of mineral oil contaminated by polyhalogenated organic material could be freed of said polyhalogenated contaminants while the mineral oil thus cleaned would be recovered for further use, without degradation.

It is well known to organic chemists that halogenated organic molecules can be reacted with sodium, with the corresponding formation of sodium halide. This type of reaction designated by the name of their conceptors:- Wurtz or Wurtz-Fittig were already known at the turn of this century (Organic Chemistry, Fieser & Fieser, 3rd edition (1956) pp. 35 and 534). For the destruction of a substance such as hexachlorobenzene, the equation of the process is:

$$C_6Cl_6+6Na\rightarrow 6NaCl+6C$$

Using such a reaction, PCB or other halogenated materials can be destroyed while non halogenated mineral oils contaminated by a minor amount of halogenated material are not affected by the action of sodium.

The implementation of such a treatment by metallic sodium has been recommended in several recent patents for the purification of mineral oils contaminated by PCB. For example, Norman (U.S. Pat. No. 4,379,752), Norman and Handler (U.S. Pat. No. 4,379,746) and Jordan (U.S. Pat. No. 4,340,471) have recommended the use of fine dispersions of metallic sodium in hydrocarbons as an efficient method of removal of minor amounts of PCB from said hydrocarbons. The recommended operational temperatures are spread over a range of 75° C. to 150° C. Other patents indicate the use of sodium combined with aromatic anions (Parker and Sabo, U.S. Pat. No. 4,447,667) or with alcohols of various structures: Pytlewski, Iaconianni et al, U.S. Pat. No. 4,417,977 and Pytlewski and Thorne, U.S. Pat. No. 4,430,208. These reagents incorporating the sodium are used after their formation for the treatment of the contaminated oils.

The implementation of these recommended protocols has been found in practice as not too practical or attractive. The fine dispersions of sodium particles, in the micron range size, are very reactive initially but when the reaction has started with the PCB, the sodium soon gets coated with the sodium halide resulting from the reaction; it agglomerates in lumps and loses much of its reactivity. For those reasons, substantial excess of sodium are required to achieve the treatment and residues after treatment still containing sizable amounts of unreacted metal, such pyrophoric material creating handling problems. Also, because of the coating of the sodium, rather long reaction times are required, generally measured in hours. This may lead to some degradation of the oil exposed to such a long period at temperature often above 125° C. When sodium is combined with aromatic anion or alcohols, the recovery of these substrates for sodium render the operation of treatment both complex and economically non attractive.

Therefore it is obvious that a process simple in its operation and allowing for a fast reaction would be highly desirable.

SUMMARY OF THE INVENTION

In accordance with the present invention, there is now provided an improved process for the destruction of polyhalogenated substances contained in liquid hydrocarbon oils, the improved process being efficient, simple and the speed of the reaction improved by a factor of 10 to 100 times over the prior art processes.

Essentially, the improved process for the destruction of polyhalogenated hydrocarbons present in liquid hydrocarbon oils by the action of sodium or potassium whereby the corresponding sodium or potassium halide is formed, comprises carrying out the reaction at a temperature of at least the melting point of sodium or potassium in the presence of a particulate inert material which is under constant agitation and the reaction is carried out in the presence of an inert atmosphere.

The improved process of the present invention provides for the coating of the particulate inert material with a thin film of sodium or potassium and after formation of the sodium or potassium halide, the latter is prevented from accumulating over sodium or potassium coated or wetted particulate inert material because of the abrasive effect derived from the constant agitation of the coated particulates, thus making substantially all of the sodium or potassium continuously available for its reaction with the polyhalogenated hydrocarbon and obviating the use of large excess of sodium or potassium and relatively long contact times which are required in the prior art processes to degrade polyhalogenated hydrocarbons.

In a further aspect of the improved process of the present invention, there is provided the possibility, because of the fixation of sodium or potassium on particulates, of a continuous countercurrent process, said countercurrent arrangement allowing contact of the last traces of polyhalogenated hydrocarbon with large excess of fresh sodium or potassium, at the discharge of the system while the last traces of sodium or potassium are used up entirely by maximum concentration of polyhalogenated hydrocarbon at the inlet of the system.

DETAILED DESCRIPTION OF THE PRESENT INVENTION

In accordance with the present invention, it has been found that the efficiency of sodium or potassium in the degradation of polyhydrogenated hydrocarbons contained in liquid hydrocarbon oils can be unexpectedly increased from 10 to 100 folds by dispersing the sodium or potassium in liquid form on an inert solid phase made of particulate form whereby the amount of sodium or potassium made available for reaction is substantially increased.

For example, it can be calculated that 100 ml of sand with grains of near spherical configuration and having a diameter of 0.5 mm represent a surface area in the order of one square meter. It has been unexpectedly observed that, if the sand is coated or wetted with a given quantity of liquid sodium or potassium, the surface of sodium or potassium made available for reaction is much greater than that of the initial surface of the molten sodium or potassium which has a tendency to agglomerate when dispersed in hydrocarbons. This tendency to agglomeration is noted even with fine dispersion of sodium or potassium in the micron range size, as recommended in recent patents.

Furthermore, since sodium or potassium halide is formed in the reaction with the polyhalogenated hydrocarbons, the resulting sodium or potassium halide agglomerate over particles of sodium or potassium whereby this coating decreases the quantity of sodium or potassium available for the reaction thus requires a large excess of sodium or potassium to insure a complete reaction. In the present invention, the agglomeration of sodium or potassium halide is prevented by keeping the sodium or potassium spread over particulate inert material in constant movement by stirring whereby, due to the friction within the stirred mass, the sodium or potassium halide formed is prevented from blocking access to the surface of the sodium or potassium thus ensuring readily access of the halogen in the polyhalogenated hydrocarbon to fresh sodium or potassium. The efficiency of this abrasion is a function of the momentum transferred to the sand by the stirring. Accordingly, the grain size of the particulate inert material is important, appreciating that too coarse a particulate will not offer sufficient surface while too fine a particulate will not carry enough momentum to ensure good abrasion. In accordance with the present invention, it has been found that a particulate inert material having a grain size within the range of about 1.0 mm to about 75 microns is appropriate.

The nature of the particulate inert material is also of significance. Obviously, the inert material must be one which will not react significantly with sodium or potassium under the prevailing conditions in the course of the process of the present invention. The density of the selected particulate inert material is of significance since, besides being essential for the transmission of mechanical energy, the density must be high enough to facilitate its separation from the treated oil. In the course of such a separation, either by settling or by centrifugation, a high enough density is desirable since it will accelerate the separation of phases.

In accordance with the present invention, it has been found that the density of the selected particulate inert material must be at least 2.0. As an example of suitable particulate inert material which can be used in accordance with the present invention, there may be mentioned silica (d:2.19), zirconium oxide (d:5.89), alumina (d:3.97), rutile (d:4.26) and feldspars (d:2.5–2.7), with silica (sand) being a preferred inert material. Generally speaking, it will be understood that a metal oxide which is generally inert towards sodium or potassium and having a density of at least 2.0 will be suitable for the purposes of the present invention. Also mixtures of oxides such as forsterite ($Mg_2SiO_4$, d:3.2) and mullite ($Al_6Si_2O_{13}$, d:3.23) can advantageously be used. Accordingly, the term "particulate inert material", when used herein, is intended to cover metal oxides having a density of at least 2.0 and which are inert to sodium or potassium at the temperatures used in the treatment.

The efficiency of stirring is also of significance. The purpose of stirring is mainly to supply fresh surfaces of sodium or potassium through abrasion of the coating which develops rapidly on the surface of the reacting metal. The efficiency of such an operation does not depend solely on the speed of stirring; too high a speed will lead to some cavitation, leaving a substantial fraction of the sand more or less static if the profile of the impeller and of the reaction vessel is not adequate. It has been found that a profile of impeller insuring a circulation upward in parallel to the axis of the stirrer and then downward along the walls of the reactor is highly efficient. Turbulence contributes to the efficiency. As to the range of speed, this will vary according to the size of the reactor, the important point being to insure a constant turbulent rather than laminar circulation of the entire mass of the inert material.

The ratio of particulate inert material to oil is also another important variable which is related to the mesh size and to the density of the inert particulate. It is also related to the amount of sodium which has to be dispersed and exposed to the halogenated hydrocarbon along with the concentration of said halogenated hydrocarbon in the impure oil. Taking those factors into account it has been found that a weight of sand from 5% to 50% of the weight of oil to be treated is appropriate with preferred values in the range of 15 to 25%. Potassium, although more expensive than sodium, is also suitable for the purposes of the present invention but provides a quicker reaction than sodium.

The term "polyhalogenated hydrocarbons", when used herein, is intended to include aromatic organic products containing at least two halogen atoms such as polychlorinated biphenyls also known generally as PCB and polybromobiphenyls also known as PBB.

The improved process of the present invention may be practiced on various functional fluids contaminated with widely varying amounts of halogenated organic compounds. The present process is particularly useful for removing halogenated organic compounds such as PCBs or PBBs from fluids, particularly transformer oils.

The amount of sodium or potassium used in the present process depends on the concentration of the PCB or PBB contaminants and other sodium reactive materials present. Prior to carrying out the process of the present invention, the contaminated oil is analyzed for its PCB or PBB content by conventional analytical procedures. The results of such an analysis provide a basis for calculating how much sodium or potassium is needed to react stoichiometrically with the halogen present in the oil and usually a small excess of about 10% of sodium or potassium will be used.

PROCESS OF THE PRESENT INVENTION

The first step in the process of the invention calls for the determination of the level of PCB in a given lot of oil to be purified. From these analyses, the amount of sodium required is calculated. The contaminated oil is placed in a reactor equipped with an efficient stirrer and the sand is added. The temperature is adjusted in a range between 100° and 125° C. and the system, while hot and well stirred is flushed with nitrogen or an inert gas in order to expel any trace of moisture and oxygen. At this juncture, the sodium is added, with 10% excess over the calculated amount. The reaction sets in rapidly and is complete after less than fifteen minutes. The sand is then separated from the oil either by settling, without stirring or by centrifugation. The treated oil is then filtered and ready for use while the sand can be used again with a new charge of contaminated oil. It will be noted here that the excess of sodium from the first operation remains available for the second treatment with this sequence, said sodium being kept on the sand. This ability of making use of the whole amount of sodium is one of the significant advantages of the present invention. Besides the economy involved, this situation prevents the formation of pyrophoric wastes. After ten to twenty runs, depending on the level of PCB in the treated oils, the sand is reprocessed the following way. The held up volume of oil in sand is washed from the sand with a low boiling solvent (hexane for example) and the sand is then washed with water to remove the sodium chloride which is discarded as a 1% NaCl solution. After drying and sieving to remove the finer fraction, the sand is recycled to the system. The low boiling solvent used for the extraction of oil from the spent sand is recycled by distillation, allowing complete recovery of oil, without objectionable wastes.

The efficiency of treatment can reach easily less than 1 ppm of PCB from contaminated oils containing more than 2000 ppm of PCB initially, particularly if an excess of sodium or potassium is added at the end of the treatment. This excess is very desirable to achieve rapidly the removal of last traces of PCB and most of this excess of sodium or potassium remains available as explained above for the treatment of the next batch.

The set up described here is of batch type, which is adequate since the reaction time is very short. It will be readily obvious to those familiar in the art that a countercurrent continuous system could be operated, taking advantage of the fact that the sodium is kept on the sand and therefore, can circulate countercurrent to the flow of oil.

ADVANTAGES

The improved process of the present invention provides many advantages over the processes of the prior art. For example, the speed of the reaction is increased from 10 to 100 times over the speed of reaction of prior art processes. Because of this, the improved process allows for a decrease in the size of the equipment. Essentially, what is needed is a reaction chamber provided with inlets for the particulate inert material, contaminated oil, sodium or potassium and inert gas, a mixing blade and outlets for the purified oil and particulate inert material and sodium or potassium chloride. In practice, a reaction chamber of 4000 liters is sufficient to treat 4000 liters of contaminated oil in about twenty minutes. Since the reaction time is very short, it is estimated that 10000 liters of contaminated oil can be treated per hour with an equipment of that size, taking other operations such as filtration into account.

Another advantage is that since the sodium or potassium used in the reaction coats the particulate inert material, any unreacted sodium or potassium will remain with the solid phase after removal of the oil phase, that is, the purified oil. Accordingly, the novel process provides for the recycling of substantially unreacted sodium or potassium in the subsequent purification or degradation treatment.

It will be noted that in the initial reaction, a very slight excess over the estimated stoichiometric amount of sodium or potassium is used. At the end of the reaction, if it is desired to reduce the amount of polyhalogenated hydrocarbon to a very low level such as less than 0.01 ppm for example, a further quantity of sodium or potassium sufficient not only to terminate the ongoing reaction, but also sufficient to at least provide the stoichiometric amount required for the next batch of contaminated oil is added, thus speeding up the elimination of last traces of PCB. So essentially, the novel improvement provides that substantially all of the sodium or potassium not used in the reaction at one time can be recycled in the subsequent run.

Another important advantage of the improved process of the present invention is that the sodium or potassium halide formed needs not be removed after each batch. The fact that sodium or potassium halide formed in a previous batch or cumulated from previous batches are present in a subsequent batch does not hinder in any way the reaction of the latter. Agitation of the reaction mass will prevent deposit of the sodium or potassium halide over the sodium or potassium coated or wetted particulate inert material. The presence of sodium or potassium halide will in no way hinder any subsequent reaction until such time as its concentration reaches about 10% by weight of the particulate inert mass. The amount of 10% of sodium or potassium halide by weight of the particulate inert material is obtained after about 25 batches have been processed wherein the concentration of the PCB or PBB in the contaminated oil is about 1000 ppm per batch, under typical operational conditions.

EXAMPLES

The present invention will be more fully understood by referring to the following Examples which are given to illustrate the practice of the invention rather than limit the scope thereof.

EXAMPLE 1

In a three flask equipped with a nitrogen inlet, a stirrer and an inlet for sodium and a thermometer, a lot of 200 g of purified grade of xylene (mixture of the three isomers) containing 0.510 g of hexachlorobenzene was introduced and heated to 125° C., while being flushed by a stream of nitrogen. After fifteen minutes of stirring at 125° C., 0.80 g of sodium (10% excess) was added and the stirring operated at maximum value. The sodium was very rapidly dispersed as a cloud of tiny particles. After a few minutes however, it recombined into lumps coated with a gray black coating. The metallic luster typical of molten sodium was gone.

At five minute intervals after the addition of sodium a one ml sample was extracted from the reaction mixture and analyzed for the presence of hexachlorobenzene using a VPC instrument to that purpose (Hewlett- Packard, Model 5716 instrument, column OV-101, 25 meters, at 160° C.).

After one hour under those conditions only three percent (3%) of the hexachlorobenzene present in the system had been destroyed from these analysis. Then a weighted sample of 75 g of silica sand, 0.4 to 0.6 mm in diameter, well dried and preheated to 120° C. was introduced in the reaction system, while keeping the stirring to maximum value (≈300 rpm). There was an immediate cleaning of the surface of sodium, the metallic luster being noted. The sodium then was dispersed throughout the mass of sand. Samples were taken at every two minutes after the addition of sand. The analysis indicated that five minutes after the addition of sodium 95% of the hexachlorobenzene had been destroyed, this destruction reaching 99.9% after seven minutes. The destruction of the hexachlorobenzene is accompanied by the formation of free carbon as expected from the equation of the reaction, this free carbon acting as a good indicator of the progress of the operation.

After the operation, the reaction mass is filtered to remove sand and the carbon particulates in the xylene are removed by filtration with a filtering aid such as diatomaceous earth or Fuller earth.

The sand is washed with water, dried and sieved before being available to be used again.

This experiment establishes clearly the very important acceleration of the speed of the reaction induced by the incorporation of particulate material in the reaction mass.

EXAMPLE 2

A. In a three neck flask equipped with a nitrogen inlet, a stirrer, an inlet for sodium and a thermometer, 125 g of zircon sand (0.4 to 0.6 mm particles) was suspended in 250 g of oil (Voltesso ® 35) containing 1.373 g of hexachlorobenzene. The suspension of the sand in the oil was maintained by strong agitation, under nitrogen atmosphere while the charge was heated up to 125° C. by external heating with an oil bath.

When the temperature had reached 125° C. in the reaction flask, 1.33 g of sodium (100% excess) was added in one portion. The sodium was noted to disperse rapidly within the mass of sand under stirring and the treatment followed by analysis of aliquots by V.P.C. After 20 minutes, the unreacted hexachlorobenzene represented 0.2 ppm.

Half an hour after the initial addition of sodium, a fresh portion of (125 ml) oil contaminated with 0.670 g of hexachlorobenzene was added to the now cleaned oil and again the kinetic of the treatment was followed by V.P.C. It was found that the amount of the unreacted hexachlorobenzene was 0.2 ppm after thirty minutes of its addition to the reaction mixture.

This example establishes that the system sodium-sand is quite efficient and that excess sodium left on the sand can be used for further treatment.

B. An experiment similar to A was repeated except that the sodium was first dispersed over the sand in the oil at 125° C., in the absence of polyhalogenated material, the hexachlorobenzene contaminated oil being added after 30 min. of stirring. With this procedure 99% of the hexachlorobenzene was destroyed five minutes after the addition of the contaminated oil, the amount of the remaining hexachlorobenzene being 0.2 ppm after ten minutes.

This example indicates that sodium already dispersed over sand is highly efficient as a reagent to remove the polyhalogenated contaminants.

EXAMPLE 3

An experiment identical to Example 2 was performed, using silica sand 0.4 to 0.6 mm in diameter of grains instead of zircon sand. The beneficial effect of silica sand was noted again, and there remained 0.2 ppm of unreacted hexachlorobenzene nine minutes after the addition of the sand.

EXAMPLE 4

An experiment identical to Example 2 was performed, using a sand of forsterite 0.5 to 0.9 mm in diameter of grains instead of zircon sand. The destruction of hexachlorobenzene was essentially complete (99.7%) eight minutes after the addition of the sand.

EXAMPLE 5

In this experiment, the procedure of Example 2 was modified the following way: 100 g of zircon sand 0.4 to 0.6 mm in diameter was used initially with 250 g of transformer oil type "Voltesso ® 35" containing 0.605 g of PCB type 1242. The procedure was the same otherwise and after the reaction there remained 0.5 ppm of PCB after twenty minutes. Then another portion of sodium was added (0.9 g) and the contact maintained for another five minutes at 140° C. The amount of unreacted PCB was 0.1 ppm.

EXAMPLE 6

An experiment similar to Example 5 was repeated except that the oil was decanted under an atmosphere of nitrogen, the sand and excess sodium kept in the flask and a new charge of oil (250 g) containing PCB (type 1242, 0.595 g) was introduced in the system. The treatment was then repeated using the excess of sodium from the previous run as the reagent and adding fresh sodium only at the end of the reaction. The amount of unreacted PCB was 0.2 ppm.

What is claimed is:

1. In a process for the dehalogenation of polyhalogenated hydrocarbons from an oil containing same wherein the dehalogenation is carried out through the reaction of sodium or potassium, the improvement which comprises contacting a dispersion of sodium or potassium over the surface of a particulate inert material having a density of at least 2.0 with a polyhalogenated hydrocarbon contaminated hydrocarbon fluid, said mixture being in an inert atmosphere, heated to a temperature of at least 100° C. and under constant agitation whereby the sodium or potassium coated on the surface of the particulate inert material reacts with the halogen of the polyhalogenated hydrocarbon to form the corresponding sodium or potassium halide which is constantly removed from the active surface of the sodium or potassium by abrasion and recovering the hydrocarbon fluid substantially devoid of polyhalogenated hydrocarbon.

2. The process of claim 1, wherein after the initial sodium or potassium has reacted with a substantial portion of the halide of the polyhalogenated hydrocarbon, a further amount of sodium or potassium is added in an amount sufficient to remove substantially all the remaining halogen of the polyhalogenated hydrocarbon and to react with substantially all the halogen of the subsequent batch of polyhalogenated hydrocarbon to be dehalogenated by being retained on the particulate material when the treated oil is removed from the system.

3. In a process for the dechlorination of polychlorinated biphenyls from an oil containing same wherein the dechlorination is carried out through the reaction of sodium or potassium to form the corresponding sodium or potassium chloride, the improvement which comprises adding sodium or potassium to a mixture of a particulate inert material having a density of at least 2.0 and a polychlorinated biphenyl containing oil, said mixture being in an inert atmosphere, heated to a temperature of at least 100° C. and under constant agitation whereby molten sodium or potassium coats or wets the surface of each particle of inert material and then reacts with the chlorine atoms of the polychlorinated biphenyl to form the corresponding insoluble sodium or potassium chloride and recovering the treated oil essentially free of polychlorinated biphenyl.

4. The process of claim 3, wherein after the added sodium or potassium has reacted with a substantial portion of the chloride of the polychlorinated biphenyl, a further amount of sodium or potassium including the amount required to react with substantially all of the remaining chlorine atoms in the batch under treatment and the amount required to react with substantially all the chlorine atoms of the next batch of polychlorinated biphenyl, the carry over of reactive metal being achieved by fixation of the alkali metal over the surface of the particulate.

5. The process of claim 1 wherein the particulate inert material has a particle size of about 1.0 mm to about 75 microns.

6. The process of claim 2 wherein the particulate inert material has a particle size of about 1.0 mm to abot 75 microns.

7. The process of claim 3 wherein the particulate inert material has a particle size of about 1.0 mm to about 75 microns.

8. The process of claim 4 wherein the particulate inert material has a particle size of about 1.0 mm to about 75 microns.

9. The process of claim 1 wherein the agitation is sufficient to insure turbulence.

10. The process of claim 2 wherein the agitation is sufficient to insure turbulence.

11. The process of claim 3 wherein the agitation is sufficient to insure turbulence.

12. The process of claim 4 wherein the agitation is sufficient to insure turbulence.

13. The process of claim 5 wherein the agitation is sufficient to insure turbulence.

14. The process of claim 8 wherein the agitation is sufficient to insure turbulence.

* * * * *